United States Patent [19]

Johnson et al.

[11] Patent Number: 5,061,590

[45] Date of Patent: Oct. 29, 1991

[54] HEAT ASSISTED TONER TRANSFERRING METHOD AND APPARATUS

[75] Inventors: Kevin M. Johnson, Rochester; Bruno Primerano; Donald S. Rimai, both of Webster, all of N.Y.

[73] Assignee: Eastman Kodak Company, Rochester, N.Y.

[21] Appl. No.: 484,339

[22] Filed: Feb. 26, 1990

[51] Int. Cl.[5] ..... G03G 13/14

[52] U.S. Cl. ..... 430/126; 430/45; 355/271

[58] Field of Search ..... 430/126, 99, 45; 355/271

[56] References Cited

U.S. PATENT DOCUMENTS 3,535,112 10/1970 Dolce et al. ..... 430/126

4,370,379 1/1983 Kato et al. ..... 430/126

4,927,727 5/1990 Rimai et al. ..... 430/126

*Primary Examiner*—John Goodrow

*Attorney, Agent, or Firm*—Leonard W. Treash, Jr.

[57] ABSTRACT

A toner image is transferred to a heat softened first thermoplastic outer layer of a receiving sheet, which receiving sheet also has a second thermoplastic layer on its backside. The second layer has a higher heat softening point than the first layer. Transfer is effected by securing the receiving sheet to a roller having a metal surface in contact with the second layer and bringing the first layer into pressure contact with an image bearing member while heating the roller from within to a temperature sufficient to soften the first layer and the toner but not sufficient to cause release of the second layer onto the roller.

8 Claims, 3 Drawing Sheets

HEAT ASSISTED TONER TRANSFERRING METHOD AND APPARATUS

TECHNICAL FIELD

This invention relates to transfer of electrostatically held toner images from an image member to a receiving sheet. More particularly, it relates to transfer of toner images to a receiving sheet having a heat-softenable surface layer.

BACKGROUND ART

Most prior attempts to create color images of photographic quality using the science of electrophotography have employed liquid developers. For many years it was thought that liquid developers were the only developers with fine enough particles to give the resolution ordinarily experienced in silver halide photography. Recently, multicolor images have been formed using toner particles finer than 8 microns in diameter and in some instances finer than 3.5 microns in diameter (mean particle size). With such size particles, granularity comparable to silver halide photography is obtainable.

Unfortunately, transferring a high percentage of an image of fine toner particles with good resolution is much more difficult than with larger toner particles. We have found that traditional electrostatic transfer is not particularly effective at such particle size.

U.S. patent application Ser. No. 230,394 to Rimai et al, entitled THERMALLY ASSISTED TRANSFER OF SMALL ELECTROSTATOGRAPHIC TONER PARTICLES, filed Aug. 9, 1988, now U.S. Pat. No. 4,927,727, issued May 27, 1990, describes a method of transferring toner particles by heating a receiver to a temperature which sinters the toner particles causing them to stick to each other and to the receiver thereby effecting transfer of the toner from the element to the receiver. According to a preferred embodiment, the receiver is coated with a thermoplastic polymer with a glass transition temperature such that it becomes soft in the process and the toner particles are at least partially embedded in it to assist in the transfer. According to that embodiment, the first layer of toner being transferred partially embeds itself in the thermoplastic polymer on the receiving sheet while the second and subsequent layers stick to each other and to the first layer. Thus, the thermoplastic polymer becomes soft enough to accept some embedding and the toner is heated sufficiently that discrete toner particles stick together at some points of contact. The preferred method of heating the receiver is to preheat the thermoplastic surface prior to the nip although heating a backing roller is also suggested as a less advantageous alternative or in conjunction with external heating.

U.S. patent application Ser. No. 07/405,258 to Rimai et al, filed Sept. 11, 1989 suggests that to prevent curl of such thermoplastic coated receiving sheets after finishing, a thermoplastic layer should also be coated on the side of the receiving sheet opposite that receiving the image. To aide handling of the sheet the thermoplastic chosen for this opposite side is polyethylene or polypropylene which are relatively high melting point thermoplastics which are less likely to soften and not release from surfaces supporting the back of the receiving sheet.

Multicolor toner images are generally formed by the transfer of 3 or 4 single color images in registration to a receiving sheet. High-quality resolution is presently only possible with such a multiple transfer approach by mounting the receiving sheet on a roller and rotating the roller to bring the receiving sheet through transfer relation with the consecutive single color images to transfer them in registration. A radiant preheating device above and out of contact of the receiving sheet as it enters the nip while carried by the roller is an effective and desirable approach to practicing the invention of the above application. However, temperature control and heat utilization efficiency is much easier if the roller itself provides the heat. Heating the roller effects substantial preheating as suggested in the prior application to the extent that the entire roller is heated not just the portion in the nip.

To attempt to practice thermally-assisted transfer of small toner particles with the primary heat coming from within the transfer roller, certain problems occur. An aluminum core roller with a thin layer of hard silicone rubber was heated by a conventional fusing lamp inserted inside the roller. Satisfactory transfer could be obtained of 3 and 4 color images providing very low glass transistion temperature toners were used. However, with higher glass transition temperature toners, both blistering of the paper and offset of the backside coating onto the roller occurred.

DISCLOSURE OF THE INVENTION

It is an object of the invention to provide a transfer process using heat to assist transfer of toner to a receiving sheet generally of the type described, but which permits substantial heating of the transfer drum inside its core with an elimination or reduction of heat induced defects in the receiving sheet.

This and other objectives are accomplished by substituting in the transfer process and apparatus described above, a transfer roller having a hard metallic outer surface.

If the toner image is initially carried on an image member which is also not compliant, a very narrow nip will be formed. This reduces the time available in the nip to heat the toner. An expert would expect difficulty in effecting transfer which is dependent upon at least some heating of the toner. However, with an aluminum surface transfer roller we found that transfer of higher glass transition temperature toners could be effected without blistering or offset of the backside layer than was possible with a more compliant transfer roller.

BEST MODE OF CARRYING OUT THE INVENTION

This invention is an improvement on the invention disclosed in the above-mentioned U.S. patent application Ser. No. 230,394 now U.S. Pat. No. 4,927,727, which application is incorporated by reference herein. In general, the materials associated with the receiving sheets, the imaging members and toners disclosed in that application can be used in the practice of this invention, exercising ordinary judgment of a person skilled in the art.

Figure 1:
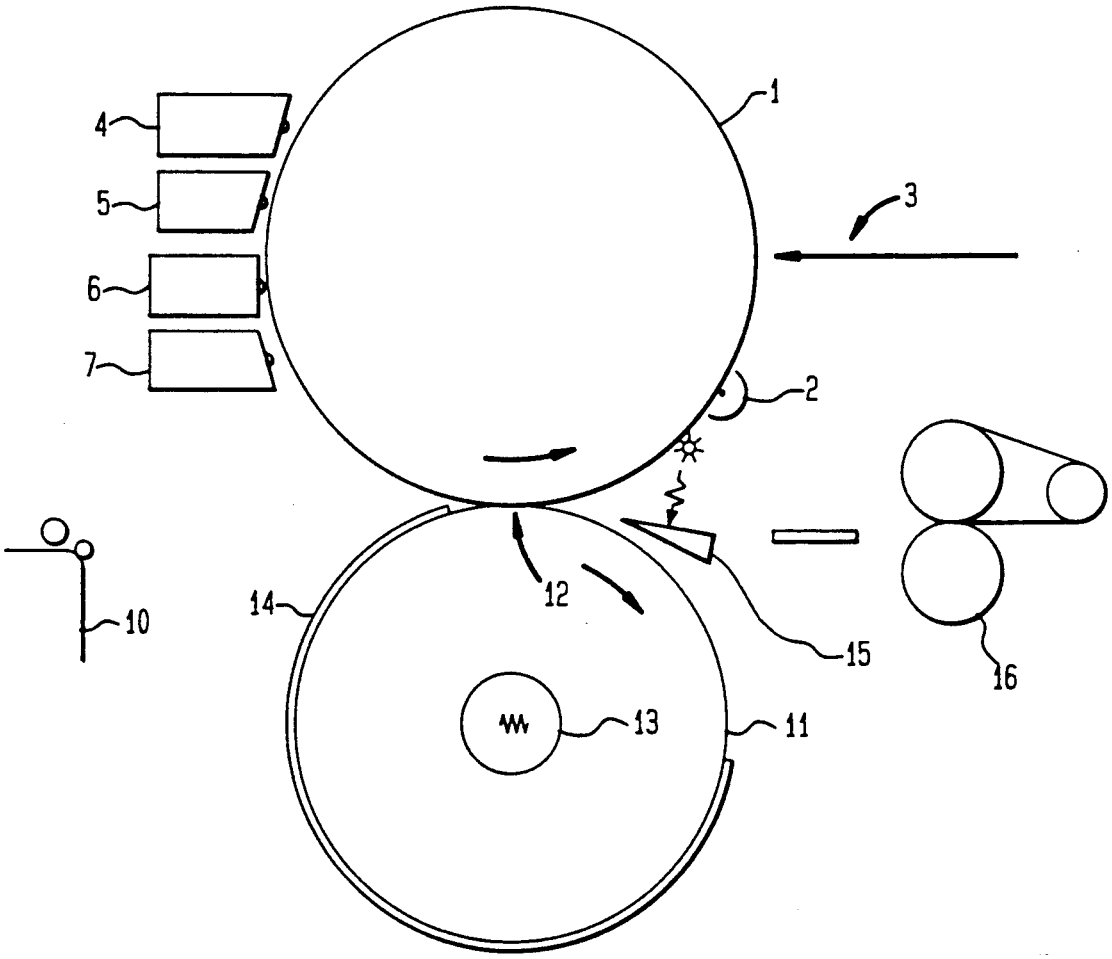
FIG. 1 is a schematic side view of an electrophotographic apparatus illustrating both the method and apparatus of the invention.

According to FIG. 1 a succession of single color images are formed on an imaging member 1 using conventional color electrophotography. More specifically, imaging member 1 which can be a photoconductive drum, is uniformly charged at a charging station 2 and imagewise exposed at an exposure station, for example, a laser 3, to form an electrostatic image which is representative of a color separation to be combined into a multicolor image. The electrostatic image is toned by one of toner stations 4, 5, 6 or 7 to create a toner image. As disclosed in said above-mentioned application, high quality color images can be obtained by using very fine particle toner, for example, toners having a mean particle size less than 8 microns and especially less than 3.5 microns.

A receiving sheet is fed from a receiving sheet supply 10 to a transfer roller or drum 11 to which it is secured by conventional means, for example, by vacuum, holding fingers, or electrostatics. Rollers 1 and 11 are rotated at a common peripheral speed through a transfer zone defined by a nip 12. Roller 11 is heated internally by a suitable heating structure, for example, a lamp 13. The combination of heat and pressure causes the toner image to transfer to the top surface of the receiving sheet 14 as it passes through the nip.

Successive electrostatic images are formed by stations 2 and 3 and toned by different color toning stations. These toner images are transferred in registration to the receiving sheet 14 to form a multicolor image thereon. The receiving sheet 14 is separated by a skive 15 which is moved into position at the appropriate time and the receiving sheet is then fed to a finishing device 16 which uses a combination of pressure and heat to fix the image to the receiving sheet.

Figure 2:
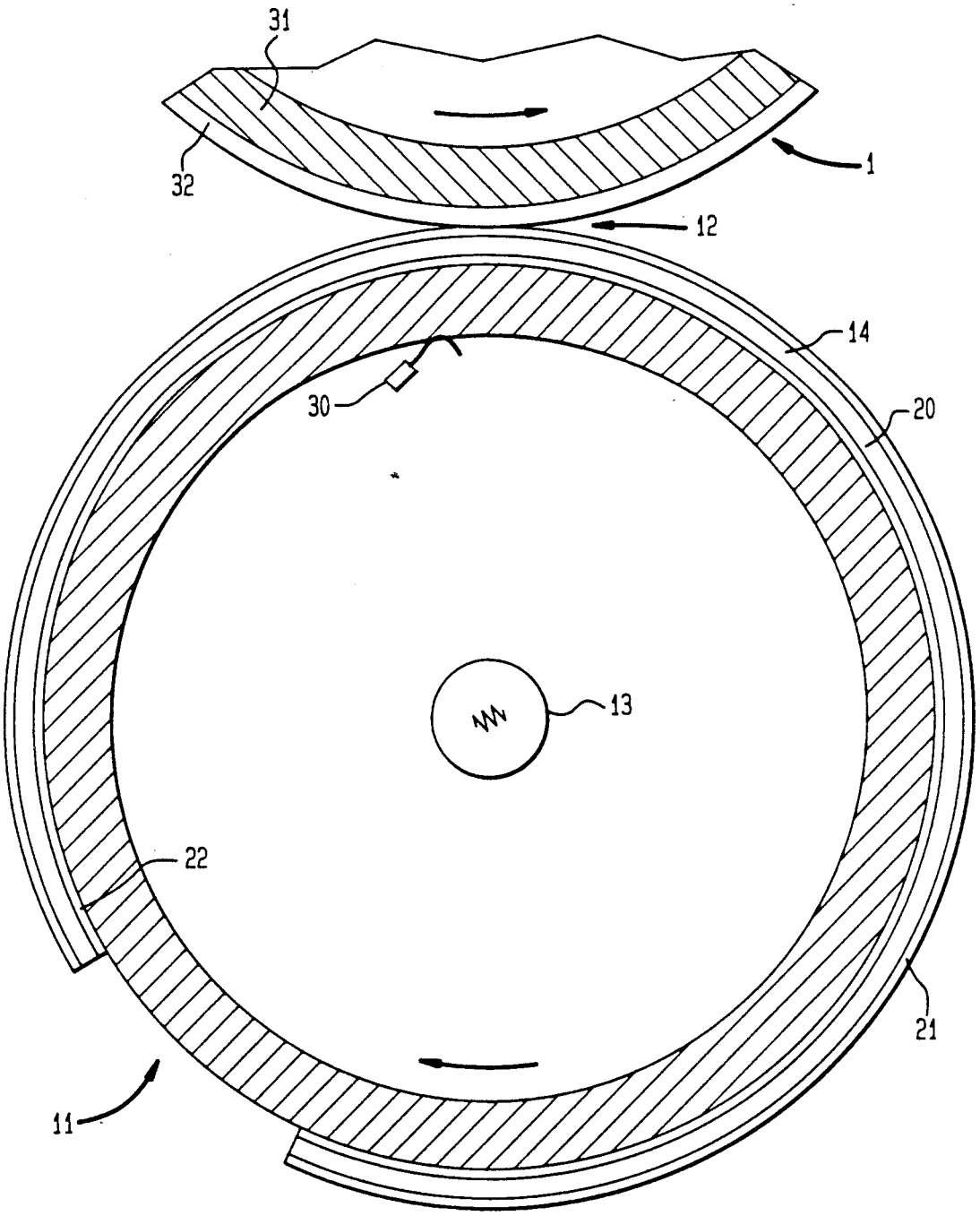
FIG. 2 is a cross-section of the transfer station portion of the apparatus shown in FIG. 1.

As shown in FIG. 2, the receiving sheet 14 is a multilayer structure which includes a paper substrate 20 and first and second heat softenable thermoplastic outer layers 21 and 22. The first thermoplastic layer 21 is intended to eventually encapsulate the image primarily through the action of the finishing portion of the process. It preferably has a glass transition temperature between 45° and 70° C., and may, for example, be one of many polyesters having such a characteristic. Other suitable materials are disclosed in said aforementioned Rimai et al application. The second heat softenable thermoplastic layer 22 is preferably of polyethylene or polypropylene or other thermoplastic having a glass transition temperature of 115° C. or greater and being of proper thickness to counter the curl tendency of the receiving sheet caused by the first thermoplastic layer 21.

Transfer roller or drum 11 is preferably formed of a metal, such as aluminum, although other thermally conductive, noncompliant materials will work in the invention. Receiving sheet 14 can be secured to roller 11 by any conventional means, not shown, for example, by vacuum, electrostatics or gripping fingers. Roller 11 is heated internally by a conventional quartz lamp 13 which is controlled by a temperature sensor which senses the temperature of the aluminum surface. Alternatively, a non-contact sensor could be used sensing the temperature associated with the surface of the first thermoplastic layer 21 just before it enters the nip. As shown in FIG. 2 a temperature sensor 30 senses the interior surface of the roller cylinder.

Image member 1 is also non-compliant. It is comprised of an aluminum core 31 upon which has been coated one or more layers 32 making the image member 1 photoconductive for use in the electrophotographic process.

It is desirable not ot overheat the nip 12. Too much heat in the nip causes damage to the photoconductive layers 32, causes blistering of the receiving sheet 14 from steam build-up in the paper substrate and softening of the second thermoplastic layer 22 creating offset of that layer onto roller 11 when the receiving sheet is stripped therefrom. However, enough heat must be applied to the nip 12 to effectively transfer the toner. Because a portion of the transfer process relies on some heat sintering of the toner itself, at least where it has touched other toner, excess heating can be obviated by choosing a toner having a low glass transition temperature. However, this is very restrictive in choice of toners, especially since a low glass transition temperature adversely affects the keeping quality of a toner.

In an attempt to get thorough heating of toner totally from inside the roller 11, apparatus comparable to FIG. 2 was first tried with a thin outer layer of hard silicone rubber on an aluminum core as a transfer roller. With this structure complete transfer of all images required such a high temperature from lamp 13 that blistering of the receiving sheet and offset of the backside of the thermoplastic layer occurred with all except the lowest glass transition temperature toners. When a plain aluminum roller as shown in FIG. 2 was tried, transfer of images made up of toner with glass transition temperatures of 70° C. and above were successfully done without blistering or offset of layer 22. This result was achieved despite the reduction in the nip length from the harder roller.

We believe this remarkable result to be due to the fluctuations in heat that occur when other than a metallic roller is used. That is, if a fresh receiving sheet is fed to the transfer roller, its temperature cools down the roller itself to a point at which the temperature sensor 30 asks for more heat out of lamp 13. Until the temperature returns to the desired temperature in the nip there is a risk that substantial amounts of toner and the thermoplastic layer onto which they are to be transferred will not be heated enough to effect complete transfer. To overcome this lack of transfer it is necessary to make the set point on the temperature sensor 30 somewhat higher, which higher set point risks damaging the photoconductor, causing blistering of the receiving sheet and offset of the backside layer 22.

With a metallic transfer roller as shown in FIG. 2, temperature control near the nip 30 has a much faster response, and higher temperature toners can be used without as high a temperature applied to roller 11. Therefore, blistering, offset of layer 22 and damage to the photoconductor do not occur with such higher temperature toners.

Figure 3:
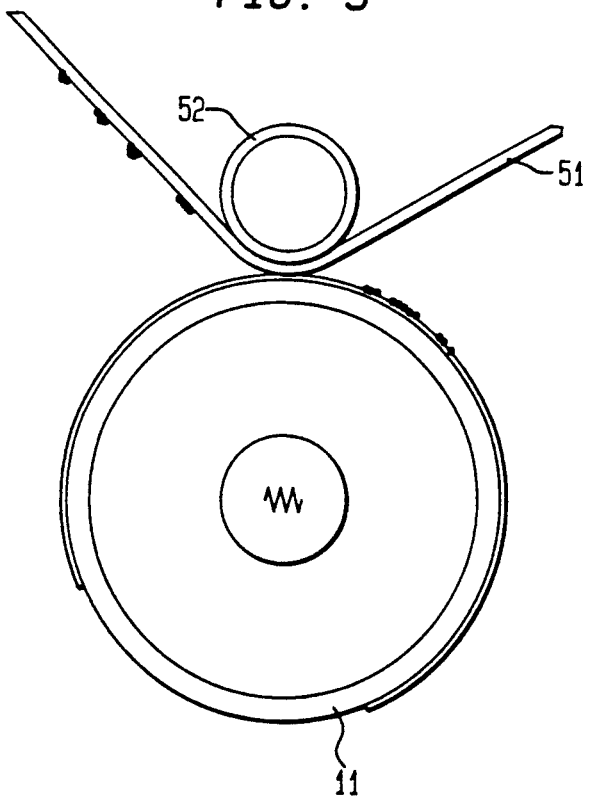
FIG. 3 is a cross-section of a transfer station of an alternative embodiment of the invention.

FIG. 3 shows an alternative embodiment of the invention in which the image member is a web 51 backed by a metallic roller 52. This structure operates as in the FIG. 1 and 2 embodiments.

Although problems with fluctuation of temperature in fusers have been known for years, it was surprising that good transfer in this process could be effected at a generally lower average transfer roller temperature with a narrower transfer nip. An expert would expect a wider nip to be necessary for proper heating of the toner. Note that external heating of the toner before it touches the receiving sheet is not considered desirable since it risks damage to the photoconductive layers 32.

In general, the process described in U.S. application Ser. No. 230,394, now U.S. Pat. No. 4,927,727 mentioned above, works best with more pressure than normal electrographic roller transfer. For example, pressures above 100 pounds per square inch are desirable. The use of two hard rollers (roller 11 and either drum 1 or roller 52) helps attain such higher pressures with lower forces urging the rollers together. For best results, each roller should be non compliant to the extent that it has a Young's modulus greater than approximately $10^9 N/m^2$. When used with higher pressures each roller should have a wall thickness of at least 1 mm.

Although the most remarkable use of the invention is that shown in the FIGS. without heating external to the roller 11, heating of the receiving sheet external to roller 11 to supplement the heating from roller 11 can also be used.

The invention has been described in detail with particular reference to a preferred embodiment thereof, but it will be understood that variations and modifications can be effected within the spirit and scope of the invention as described hereinabove and as defined in the appended claims.

We claim:

1. A method of transferring a toner image from an image bearing surface of an image member to a receiving sheet, said receiving sheet including a substrate, a first thermoplastic layer on one side of said substrate which first thermoplastic layer has an outside image receiving surface, and a second thermoplastic layer on the other side of said substrate, said first thermoplastic layer having a lower heat softening point than said second thermoplastic layer, said method comprising:

passing said image member through a transfer zone while backed by or coated on a first hard drum or roller, and passing said receiving sheet through said transfer zone with said image receiving surface in pressure contact with said toner image while backed by a second hard roller having a thermally conductive, non compliant metallic surface in contact with said second thermoplastic layer, which second roller has been heated by a heat source inside said second roller, sufficiently to soften said first thermoplastic layer to receive said toner image but not sufficiently to cause offset of said second thermoplastic layer onto said second roller.

2. The method according to claim 1 including the step of separating said receiving sheet from said second roller without substantially cooling said second layer and without causing offset of said second layer onto said roller.

3. The method according to claim 1 wherein said receiving sheet is secured to the periphery of said second roller and rotated through said transfer position a plurality of times to receive a plurality of different colored toner images in registration thereon.

4. A method of transferring a toner image, said toner image comprising particles having a mean size not greater than 8 microns, from an image bearing surface of an image member to a receiving sheet, said receiving sheet including a paper substrate, a first thermoplastic layer on one side of said substrate which first thermoplastic layer has an outside image receiving surface, and a second thermoplastic layer on the other side of said substrate, said first thermoplastic layer having a lower heat softening point than said second thermoplastic layer, said method comprising:

passing said image member through a transfer zone while backed by or coated on a first hard roller, and passing said receiving sheet through said transfer zone with said image receiving surface in pressure contact with said toner image while backed by a second hard roller having a metallic surface in contact with said second thermoplastic layer, which second roller has been heated by a heat source inside said second roller, sufficiently to soften said first thermoplastic layer to receive said toner image but not sufficiently to cause offset of said second thermoplastic layer onto said second roller.

5. A method of creating a multicolor image on a receiving sheet, said receiving sheet including a paper substrate, a first thermoplastic layer on one side of said substrate which first thermoplastic layer has an outside image receiving surface, and a second thermoplastic layer on the other side of said substrate, said first thermoplastic layer having a lower heat softening point than said second thermoplastic layer, said method comprising:

creating a series of electrostatic images on an image member, applying different colored toners to each of said images to create a series of toner images of different color, said toners comprising particles having a mean size less than 8 microns, passing said image member through a transfer zone while backed by or coated on a first hard roller, attaching said receiving sheet to a second hard roller having a metallic surface in contact with said second thermoplastic layer, rotating said second roller to bring said first thermoplastic layer through the transfer zone in pressure contact with said images a plurality of times to transfer said toner images to said thermoplastic surface in registration, and heating said second roller, solely by a heat source inside said second roller, sufficiently to soften said first thermoplastic layer to receive said toner image but not sufficiently to cause offset of said second thermoplastic layer onto said second roller.

6. The method according to claim 4 wherein said toner includes particles having a means size less than 3.5 microns.

7. The method according to claim 5 wherein said applying step includes applying toners having a mean particle size less than 3.5 microns.

8. An apparatus for forming a multicolor image on a receiving sheet, which receiving sheet includes a support with heat softenable thermoplastic layers on both sides, said apparatus including means for forming a series of electrostatic images on an image member, means for applying a different color toner to each of said electrostatic images, a transfer roller rotatable into transfer contact with said image member, said transfer roller having an outer periphery for receiving and securing said receiving sheet, means for internally heating said transfer roller, said transfer roller being rotatable with said receiving sheet on its periphery through transfer relation with said image member a plurality of times to transfer said color images in registration to said receiving sheet, characterized in that said transfer roller has a hard metallic outer surface.

* * * * *